US005400459A

United States Patent [19]

Jarecke et al.

[11] Patent Number: 5,400,459

[45] Date of Patent: * Mar. 28, 1995

[54] PAINT ROLLER HAVING ADJUSTABLE SPATTER SHIELD

[76] Inventors: James J. Jarecke, 5661 Grove Ter., Greendale, Wis. 53129; Leon C. Clouser, Jr., 581 S. Finley Rd., Lombard, Ill. 60148; Insoon Park, 4705 N. Central Park, Apt. 25, Chicago, Ill. 60625

[ * ] Notice: The portion of the term of this patent subsequent to Feb. 25, 2009 has been disclaimed.

[21] Appl. No.: 751,363

[22] Filed: Aug. 21, 1991

Related U.S. Application Data

[63] Continuation of Ser. No. 149,045, Jan. 26, 1988, Pat. No. 5,090,085.

[51] Int. Cl.[6] ..... B05C 17/02

[52] U.S. Cl. ..... 15/230.11; 401/15; 15/248.1

[58] Field of Search ..... 15/230.11, 248 A; 401/197, 15

[56] References Cited

U.S. PATENT DOCUMENTS

| | | | |
|---|---|---|---|
| 2,902,706 | 9/1959 | Gaetke | 15/248 A |
| 3,274,637 | 9/1966 | Schulze | 15/248 A X |
| 3,378,872 | 4/1968 | Frontera et al. | 15/248 A X |
| 3,457,582 | 7/1969 | Fisher | 15/248 A |
| 3,748,683 | 7/1973 | Smith et al. | 15/248 |
| 3,825,970 | 7/1974 | Hanssen | 15/230 |
| 4,011,622 | 3/1977 | Gillum et al. | 15/248 |
| 4,063,325 | 12/1977 | Lizak | 15/230.11 |
| 4,091,493 | 5/1978 | Weiss | 15/248 |
| 4,254,529 | 3/1981 | Cooke | 15/230 |
| 4,325,159 | 4/1982 | Rico | 15/248 |
| 4,569,099 | 2/1986 | Harding | 15/248 |
| 4,571,769 | 2/1986 | Ford | 15/248 A X |
| 4,593,428 | 6/1986 | Calvert | 15/248 |
| 4,667,363 | 5/1987 | Calvert | 15/248 |
| 4,696,072 | 9/1987 | Cormack | 15/248 |
| 4,765,353 | 8/1988 | Rhoades | 134/138 |

FOREIGN PATENT DOCUMENTS

| | | | |
|---|---|---|---|
| 2067926 | 8/1981 | United Kingdom | 15/248 A |

*Primary Examiner*—Steven A. Bratlie

[57] ABSTRACT

A paint roller having an adjustable shield is disclosed. The shield is adjustable by the user from a position of minimum shielding, which facilitates loading the roller with paint, to a position of maximum shielding which provides maximum spatter protection. The adjustment of the shield may quickly and easily be made with one hand by the user, and particularly by the same hand by which the roller is held.

8 Claims, 1 Drawing Sheet

PAINT ROLLER HAVING ADJUSTABLE SPATTER SHIELD

This is a continuation of application Ser. No. 149/045, filed Jan. 26, 1988, now U.S. Pat. No. 5,090,085.

This invention relates generally to shielded paint rollers and, more specifically, to a shielded paint roller having an adjustable shield whereby the user can quickly and easily vary the coverage of the roller by the shield.

Shielded paint rollers generally have the advantage of reducing, or at least confining, paint spatter associated with roller painting. Many variations of the basic shielded roller concept are known. The extent of shielding varies widely, however. A modest shielding effect, which is still effective to dramatically reduce paint splatter, is obtained when substantially less than 180° of coverage of the roller is available; for example, on the order of about 90°. This degree of shielding has the advantage of enabling paint to be loaded on the roller from a paint tray almost as quickly and easily as a non-shielded roller since there is little likelihood that the roller assembly will be presented to the pool of paint in the paint tray at such an angle that the edges of the shield will contact the paint and therefore drip following removal. In addition, such a roller is easier to use with a handle extension for ceiling work, or for corner work, than an extensively shielded (i.e.: up to about 180° of circumference) roller. Such a roller is not as effective, however, in protecting the user from paint spatter during use as a more extensively shielded roller is.

An extensively shielded roller, by the same token, requires greater user skill to load with paint so as to avoid post-loading dripping, and to work on ceilings or in corners than the partially shielded roller, but it has the very great advantage of providing maximum spatter protection to the user and the surroundings.

SUMMARY OF THE INVENTION

The invention is a paint roller assembly which includes a roller, a handle, means for supporting the roller for rotation with respect to the handle and an adjustable shield means for substantially reducing or eliminating spatter during use, the adjustable shield means including a first, fixed shield and a second, adjustable shield which may be quickly and easily operated by a user to extend from, and retract into, the fixed shield.

Accordingly, a primary object of the invention is to provide an adjustably shielded paint roller which can be quickly and easily adjusted during each paint application by the ordinary consumer.

Another object of the invention is to provide an adjustably shielded paint roller which provides maximum spatter protection when working conditions so require, such as ceilings or corner work, yet which retracts for ease and safety of paint loading.

A further object of the invention is to provide an adjustably shielded paint roller in which a range of shield adjustment from a minimum up to approximately 180° can be provided by the use of only one moving part.

Yet a further object of the invention is to provide a paint roller in which the adjustment of the moveable shield component can be accomplished with one hand; that is, by the same hand which holds the roller. This can be especially advantageous when the user must devote one hand to maintaining or steadying his foothold, as by holding onto a ladder, and has only one hand available for loading and applying paint.

Yet a further object of the invention is to provide an adjustable shielded paint roller as above described in which a minimum shield is provided so as to obtain the benefits described above and, at the same time, the shield can be selectively extended sufficiently far so as to enable the roller to be laid on its back, loaded with paint, without fear of having excess paint drip onto a supporting surface, such as a rug or floor.

The foregoing and other advantages of the invention will become apparent from the following detailed description of the invention.

DESCRIPTION OF THE DRAWING

The invention is illustrated more or less diagrammatically in the accompanying drawing wherein.

DETAILED DESCRIPTION OF THE INVENTION

Figure 1:
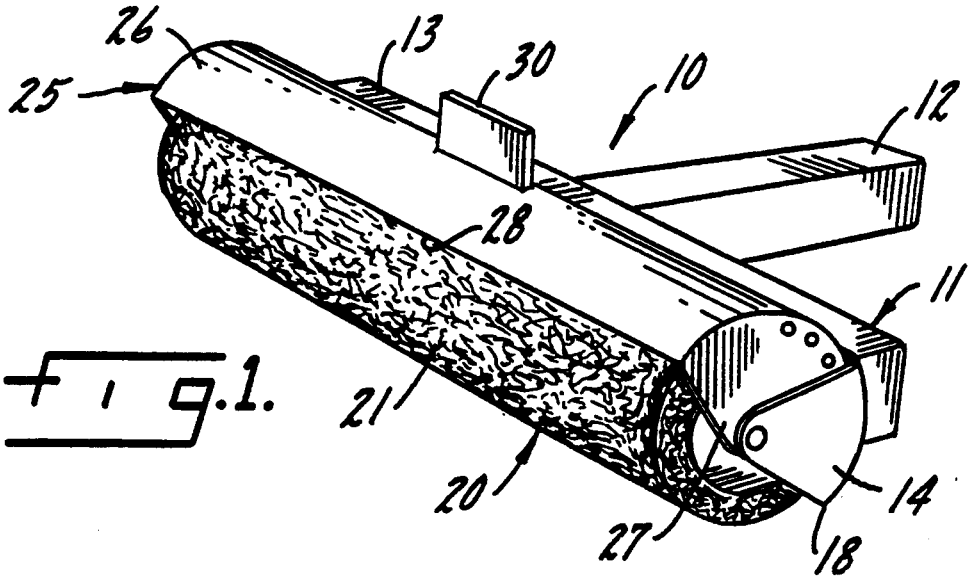
FIG. 1 is a perspective view of an adjustably shielded paint roller assembly in which the adjustable shield is shown in its maximum shielding position.

Like reference numerals will be used to refer to like parts from Figure to Figure in the drawing.

The adjustably shielded paint roller assembly of this invention is indicated generally at 10 in FIG. 1. The paint roller assembly includes a yoke, indicated generally at 11, from which a handle 12 projects rearwardly. The yoke 11 can be of any suitable shape or form. In this instance it consists of an elongated mainframe member 13 from which a yoke arm, 14, projects at each end, only one of which is shown in the Figures. Yoke arm 14 includes, in this instance, a pivot opening 15 of a size to receive a roller shaft 16 of a paint roller which is described in detail hereinafter. In this instance, the yoke arm 14 is pie shaped in contour, with the pie segment forming an angle, in this instance, of substantially less than 90°. The mainframe member 13 is shown, in this instance, as a rectangular, box-like structure which is integral with a structural member 17 which extends between the yoke arms 14. Alternatively of course the yoke arms 14 can merely be a pie shaped projection from the mainframe member 13. The yoke arms 14, structural member 17, box-like mainframe member 13 and handle 12 all function as a substantially rigid frame and base shielding member. The handle 12 will, of course, be of a length and shape suitable for easy and convenient grasping and holding during operation by the user.

A conventional paint roller is indicated generally at 20. The paint roller includes a layer of pile fabric 21 which is wrapped about a core, indicated at 22, from which pivot shaft 16 projects. If the yoke arms 14 are made from a material with some flexibility, such as plastic, though metal could also be employed, it is a simple task to manually bend the yoke arms 14 outwardly far enough to snap the paint roller 20 into place by pushing the ends of pivot shaft 16 into the pivot opening 15 in each yoke arm 14.

An adjustable shield member is indicated generally at 25. The adjustable shield 25 consists, in this instance, of a cover section, indicated at 26, which has arms 27 at each end. Each cover arm 27 is generally pie shaped, as indicated best in FIG. 2, and includes a pivot opening of a size suitable for reception of roller shaft 16 near the apex of the included angle. If the adjustable shield 25, and particularly the shield arms 27, are composed of a material having some flexibility, such as plastics or, even, metal, the assembly of the cover arm to the paint roller 20 may be accomplished by manually bending the shield arms 27 outwardly a sufficient amount to permit the roller shaft 16 to snap into place within the pivot aperture, not numbered, at the apex of each shield arm. Preferably, of course, in assembly of the unit, the adjustable shield 25 is assembled to the paint roller 20 first, and thereafter the yoke 11 is snapped onto the roller shaft 16.

Figure 2:
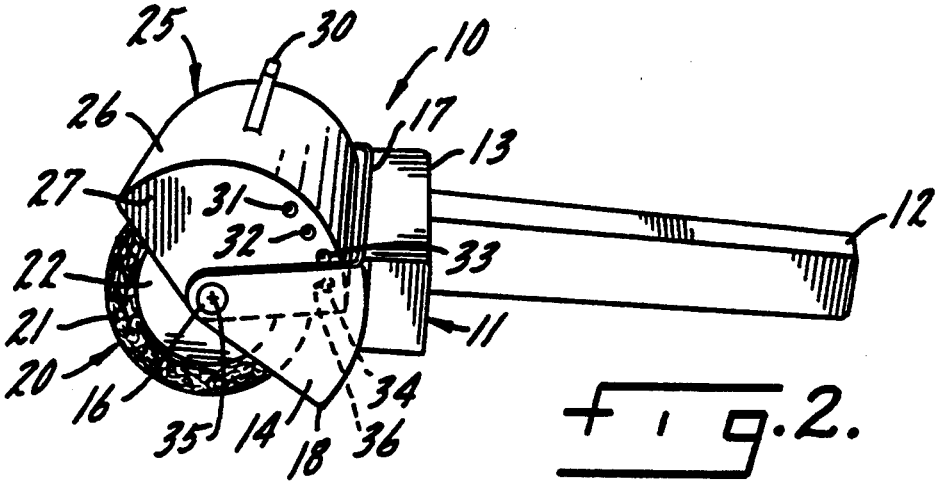
FIG. 2 is generally a side view of the adjustably shielded paint roller assembly of FIG. 1 with parts shown in outline for clarity of description.

The adjustable shield 25 can be retracted into, or extended outwardly from, the yoke 11. In FIG. 2 the adjustable shield 25 is shown in its position of maximum extension from yoke 11, and in FIG. 3 the adjustable shield 25 is shown in its position of maximum retraction into yoke 11.

The position of minimum retraction of adjustable shield 25 into yoke 11, and thereby the minimum angular or circumferential shield coverage of the paint roller, is determined, in this instance, by a locator tab 30 which projects upwardly from the outer surface of cover section 26. In the position of maximum retraction of FIG. 3, further retracting movement of the adjustable shield 25 with respect to the yoke 11 is precluded by locator tab 30 abutting against the edge of structural member 17.

Means for fixing the position of the adjustable shield 25 with respect to yoke 14 at a plurality of discrete positions between a position of minimum retraction and maximum extension is illustrated best in FIG. 2. In this Figure a plurality of depressions 31, 32, 33 and 34 are shown formed in cover arm 27. The depressions 31–34 are located on an arc of curvature whose radius is the axis 35 of roller shaft 16. A button 36 which projects inwardly from the left yoke arm 14 is located in a position to successively engage depressions 34, 33, 32, 31 when the adjustable shield 25 is moved in a retracting direction, and to similarity engage the depressions when the adjustable shield 25 is moved in an extending direction. When button 36 mates with any one of depressions 31–34, the position of adjustable shield 25 is fixed with respect to yoke 11. The depth of depressions 31–34 and the corresponding height of button 36 from its support surface can be readily established by one skilled in the art so that, when the button engages a depression, sufficient restraining force is provided to preclude relative movement between adjustable shield 25 and yoke 11 during normal operation. At the same time, when it is desired for any reason to change the position of the adjustable shield 25 with respect to yoke 11, a simple application of finger pressure to locator tab 30 will cause relative movements between the two parts.

Figure 3:
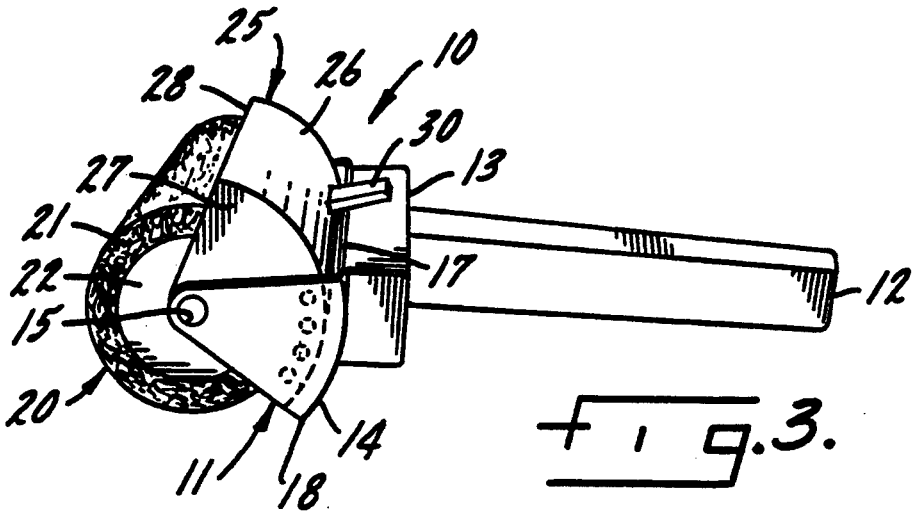
FIG. 3 is generally a side view of the adjustably shielded paint roller assembly of FIG. 1 which illustrates the fully retracted position of the adjustable shield portion of the assembly.

Relative movement between the two parts may be desired each time the roller is loaded with the paint formed in the pool in a paint tray. Thus, for example, when the adjustable shield 25 is in a position of maximum extension with respect to yoke 11, as is illustrated in FIGS. 1 and 2, maximum protection against paint spatter will be provided. This is particularly advantageous when painting a ceiling but is, of course, almost equally advantageous when painting a vertical wall. However, when it is time to reload paint onto the roller, the placement of the adjustable shield 25 into the position of FIGS. 1 and 2 requires that care be taken, by the user, in dipping the pile fabric 21 of the paint roller 20 into the paint tray to prevent dipping either the leading edge 28 of adjustable shield 25 or trailing edge 18 of yoke 11. Consequently, the user, while his hand grasps handle 12, can facilitate the paint loading operation by merely extending a finger forwardly to locator tab 30, and pulling tab 30, and thereby the adjustable shield 25, inwardly toward yoke arm 14. As mentioned, the movement of adjustable shield 25 with respect to yoke arm 11 will stop when locator tab 30 strikes the mainframe member 13. With the pile fabric 21 exposed over almost 270° of its circumference as illustrated in FIG. 3, the pile fabric 21 may be relatively quickly and easily loaded with paint. Following loading, the user operates locator tab 30 to move the adjustable shield 25 back to the fully extended position of FIG. 2, or any intermediate position, represented by depressions 32 and 33, between a fully retracted and a fully extended position.

It will also be noted that if the adjustable shield 25 is extended to its maximum extension position of FIG. 2, the paint roller 10 can be laid on a flat surface with the tip of locator tab 30 and the top of the rear end of handle 12 in contact with the surface, and the shield assembly will intercept any paint which drips from the pile fabric toward the supporting surface. This feature may be particularly important, for example, when the user, just after loading the roller with paint, is required to lay down the roller to answer the telephone or attend to some other immediately pressing matter.

Although a preferred embodiment of the invention has been illustrated and described, it will at once be apparent to those skilled in the art that modifications may be made to the illustrated and described embodiment without departing from the spirit and scope of the invention. Accordingly, it is intended that the scope of the invention be limited solely by the scope of the hereinafter appended claims, when interpreted in light of the relevant prior art, and not by the specific description of the above preferred embodiment.

We claim:

1. An adjustably shielded paint roller assembly comprising:

a paint roller;

a rigid frame including a handle for carrying the roller, pivot means for mounting the paint roller for rotational movement about a fixed axis on the rigid frame, said rigid frame including a base shielding member which is located between the axis of rotation and handle and positioned so as to intercept spatter emanating from the roller during use, and an adjustable shielding matter which can be at least partially retracted into the base shielding member to a position in which a minimum degree of spatter shielding is provided, and which can be extended from the base shielding member to a position in which a maximum degree of spatter shielding is provided, said paint roller extending from said base shielding member and said adjustable shielding member so as to leave a portion of said roller exposed when said shielding members are in said position of maximum spatter shielding and so as to allow application of paint to a surface with said roller without said shielding members contacting the surface.

2. The adjustably shielded paint roller assembly of claim 1 further characterized in that the maximum degree of spatter shielding of the paint roller is about 180° of the circumference of the paint roller.

3. In an adjustably shielded paint roller assembly of claim 1 further characterized by and including position adjustment means for adjustably fixing the adjustable shielding member at intermediate positions of shielding coverage between positions of minimum and maximum spatter shielding.

4. The adjustably shielded paint roller assembly of claim 3 further characterized in that the position adjustment means includes projection means and detent means carried by the rigid frame and the adjustable shielding member which, when in engagement with one another, fix the position of said rigid frame and adjustable shielding member until a position changing force is applied thereto.

5. The adjustable shielded paint roller assembly of claim 3 further including actuating means for applying position changing forces of a magnitude sufficient to change the position of the rigid frame and the adjustable shielding member relative to one another.

6. The adjustable shielded paint roller assembly of claim 5 further characterized in that the actuating means are so located as to be actuated by the user with the same hand which holds the frame.

7. The adjustable shielded paint roller assembly of claim 6 further characterized in that the actuating means is carried by the adjustable shielding member.

8. The adjustable shielded paint roller assembly of claim 7 further characterized in that the actuating means also functions as a retraction limit means by abutting a portion of said rigid frame, thereby establishing the position in which a minimum degree of spatter shielding is provided.

* * * * *